United States Patent [19]

Frain

[11] Patent Number: 4,981,301

[45] Date of Patent: Jan. 1, 1991

[54] BINGO GAME FOR MULTIPLE PLAYS

[76] Inventor: John J. Frain, 40 Kildare Walk, Breezy Point, N.Y. 11697

[21] Appl. No.: 426,555

[22] Filed: Oct. 25, 1989

[51] Int. Cl.[5] ..... A63F 3/06

[52] U.S. Cl. ..... 273/240; 273/269; 283/49

[58] Field of Search ..... 273/240, 269, 270; 283/49, 50, 65

[56] References Cited

U.S. PATENT DOCUMENTS

| | | | |
|---|---|---|---|
| 3,534,963 | 10/1970 | Weimer | 273/277 |
| 3,731,935 | 5/1973 | Moore | 273/270 |
| 4,133,536 | 1/1979 | Cole | 273/269 |
| 4,165,878 | 8/1979 | Frain | 273/240 |

*Primary Examiner*—Edward M. Coven
*Assistant Examiner*—William M. Pierce
*Attorney, Agent, or Firm*—Watson, Cole, Grindle & Watson

[57] ABSTRACT

A game board and marker sheet are provided to allow multiple plays of Bingo games and the like. The game board comprises a panel having defined rectangular areas located on an upper surface. Each defined area has an associated window and an associated reference character. The marker sheet is located below the panel and has groups of colored markings arranged in two perpendicular directions on both sides of the sheet. Each group corresponds to a defined area and a marking of each group is visible via the associated windows to allow the marking to be cancelled if the associated reference character is announced. Upon completion of a game, the panel is moved relative to the marker sheet by positioning the panel on pegs which pass through openings in the sheet and panel. The panel openings are arranged in two perpendicular directions in the same fashion as each group of markings. Accordingly, the colored marking of each group is visible via the windows for another announced game of a particular color. Once an entire group has been marked, the marker sheet may be flipped over and positioned on the pegs for further play. Thus, the number of games which can be played with a single marker sheet is maximized.

13 Claims, 2 Drawing Sheets

BINGO GAME FOR MULTIPLE PLAYS

BACKGROUND OF THE INVENTION

1. Technical Field of the Invention

This invention relates to improvements for the playing of a Bingo game or the like, and more particularly to a game board and marker sheet which permit multiple games to be played using a single marker sheet.

2. Discussion of the Related Art

It is well known to play Bingo or similar games with "hard cards" of sufficient rigidity to permit repeated use. In the course of a single play, a player will cancel the announced Bingo numbers with chips, corn kernels, shifting slides, or the like.

During an extended Bingo session, "specials" are typically played using "special" paper sheets imprinted with Bingo numbers which are color-coded to identify the particular "special." These paper sheets are suitable for only one play since a marker is used to cancel the announced number. In addition, these "special" sheets are often numbered with progressively different plate numbers and further provided with special numbers to prevent tampering.

Thus, much time and effort is spent in this tamper-proofing process. This time and effort is further multiplied by the fact that normally a sheet can only be used for a single play. In addition, this single play results in significant amounts of paper being used in each Bingo session.

My earlier patent, U.S. Pat. No. 4,165,878, describes a Bingo game and process of playing the same wherein a pocket is provided for a card having a predetermined pattern of markings. This card is inserted within the pocket and positioned at predetermined intervals in the direction of insertion so that various sets of markings are sequentially visible via openings in the pocket. Accordingly, a single card is available for multiple plays.

However, it is advantaqeous to provide a game board which allows a "special" card to be used for an even greater number of plays. Also, simplification of the manufacturing process and reduction of materials are also desired results.

It is therefore an object of the present invention to provide an improved device and process for effecting play of Bingo games and specials which results in a significant reduction in paper or other printed materials.

It is another object of the present invention to further reduce the time and effort involved in tamper-proofing "special" cards by eliminating full coloring of the cards and reference numerals or characters.

It is a further object of the present invention to accomplish the foregoing objects via a relatively simple manufacturing process.

These and other objects will become apparent from the specification and drawings which follow.

SUMMARY OF THE INVENTION

The foregoing and additional objects are obtained by a game board for the play of a game such as Bingo which includes a panel having a plurality of areas of a predetermined size defined on an upper surface of the panel and a plurality of windows, each window being located within one of the defined areas. Also, a plurality of characters are provided for facilitating play of the game, each character being located within a defined area of the panel. Also provided is a means for positioning the panel relative to a marker sheet in two perpendicular directions. Accordingly, the characters may be cancelled during play of the game by marking the marker sheet through the windows.

The marker sheet may have a plurality of groups of colored markings arranged in the two perpendicular directions and located on one or both surfaces thereof. Each group corresponds to a predetermined area of the panel and a marking of each group is visible via the window.

The means for positioning the panel in the two perpendicular directions may comprise a plurality of openings arranged in the two directions and at least one peg passing through the marker sheet and through at least one of the openings.

In addition, the present invention provides a process for multiple play of a board game such as Bingo. First, a panel is provided having a plurality of areas of predetermined size defined on an upper surface of said panel. A window is provided in each of the defined areas and a character is provided which is located on the upper surface and within each defined area. Next, a marker sheet is disposed below the panel, the sheet having groups of markings arranged in two perpendicular directions on a first surface thereof. Each group of markings corresponds to a defined area of the panel and a marking of each group is exposed via each window of the panel. The exposed markings of said marker sheet are then marked through the windows when the respective character is announced during play of the game. Next, the panel is moved relative to the marker sheet in the two perpendicular directions upon completion of a game to expose unmarked markings for subsequent play.

DETAILED DESCRIPTION OF THE PREFERRED EMBODIMENTS

Figure 1:
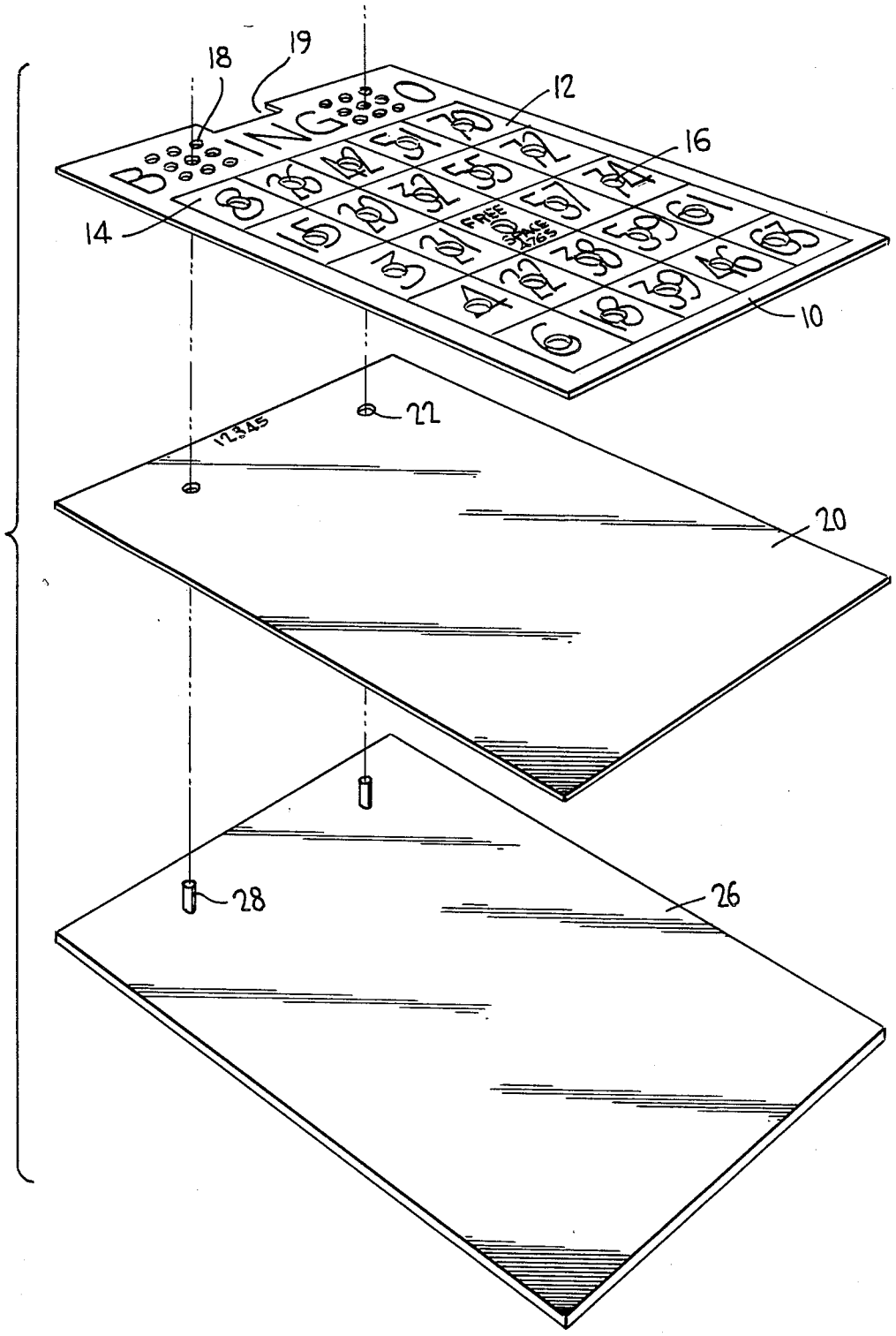
FIG. 1 is an exploded view of a game board, marker sheet, and support board according to the present invention.
Figure 2:
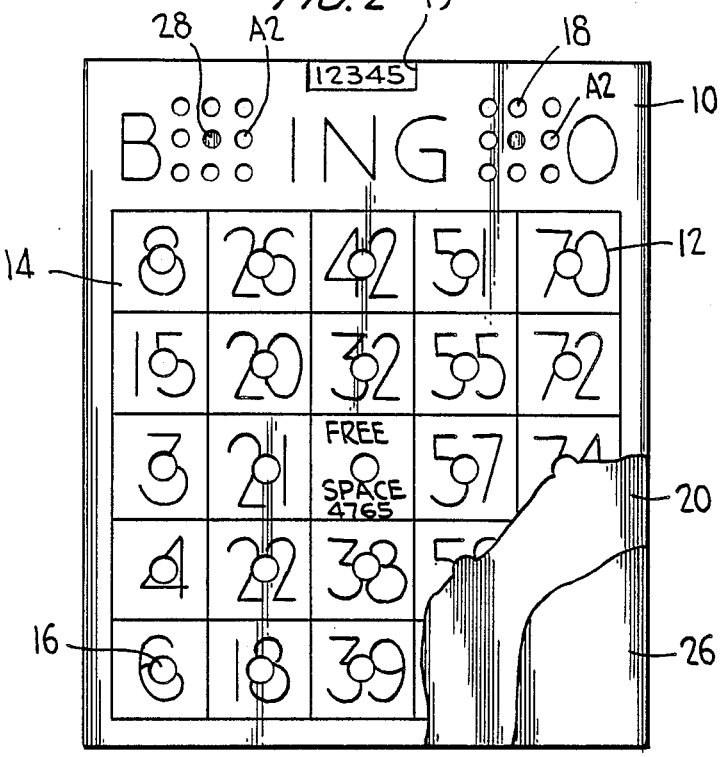
FIG. 2 is an exposed top view of the present invention.
Figure 3:
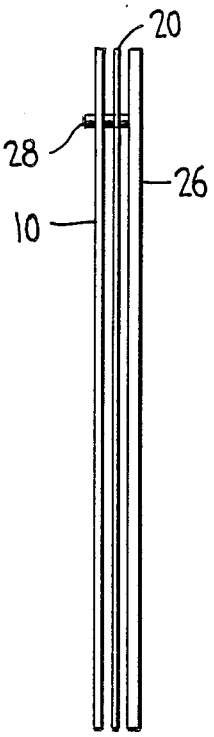
FIG. 3 is a side view of the present invention.

Turning now to the drawings wherein like reference characters refer to like and corresponding parts throughout the several views, a Bingo game board 10 is provided and comprises a single panel of standard size. Referring to FIGS. 1 and 2, the upper surface of game board 10 is marked with a plurality of parallel lines which intersect at right angles with another plurality of parallel lines to define a plurality of rectangular areas 12 of a predetermined size.

Each rectangular area 12 is marked with a reference numeral or character 14 which is to be matched with the numeral or character announced by the Bingo caller. Each defined area 12 also has a window 16 through which a "special" marker sheet 20 is visible. In addition, game board 10 has positioning openings 18 located therethrough which allow the board to be positioned in two perpendicular directions relative to the rectangular marker sheet 20, as described more fully below. These two directions are the horizontal and vertical directions of FIG. 2.

Figure 4:
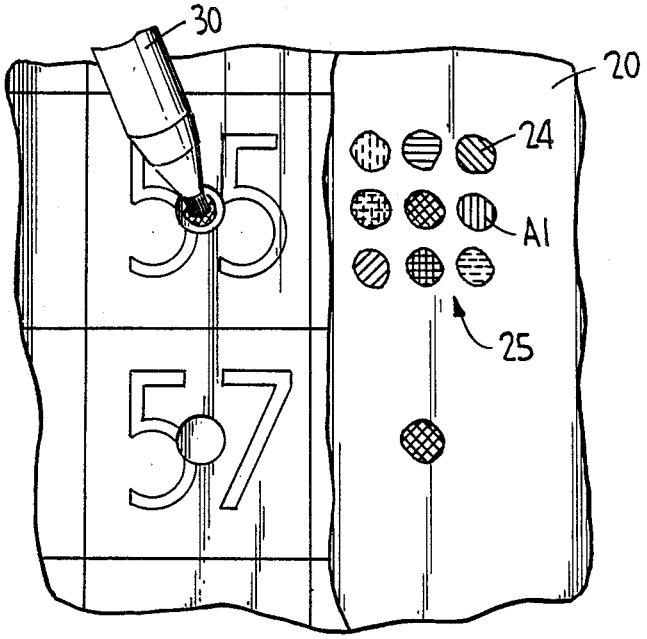
FIG. 4 is an enlarged and exposed top view of the present invention showing the marking of the colored markings of the marker sheet.

Marker sheet 20 is located below game board 10 and has a plurality of individually colored markings 24 on a first surface which are visible through the windows 16, as shown in FIG. 4. Each different color of the markings 24 corresponds to a different "special" game. These markings 24 are arranged in groups 25 which correspond to the arrangement of positioning openings 18 of game board 10. Each group 25 has the same arrangement of colored markings 24. These markings 24 may be similarly located on both opposite surfaces of the marker sheet 20.

A support board 26 is located beneath the marker sheet 20 and has pegs 28 attached to its upper surface. These pegs 28 extend through sheet openings 22 located through the marker sheet 20 and also extend through positioning openings 18.

The operation of the present invention will now be explained. Marker sheet 20 is placed on pegs 28 of the support board 26. Next, game board 10 is positioned above marker sheet 20 so that the color of the marking 24 visible via window 16 corresponds to the particular color of the "special" game announced by the caller. The game board 10 is then lowered so that the pegs 28 securely engage the opening 18 corresponding to the position of announced colored marking 24.

For example, assume that a red "special" is being played and that the marking 24 which is colored red is located at position Al in FIG. 4. The opening 18 which is aligned and engaged with peg 28 would be the location within the grouped openings corresponding to this position, i.e., opening 18 is positioned at A2. See FIG. 2.

As the caller announces specific reference numerals or characters 14, the player cancels the marking 24 of the marker sheet if the announced numeral 14 is present on his/her game board 10. This cancellation is achieved by marking the marking 24 with a pencil 30 or the like through window 16.

Once Bingo has been completed by a winning player, the caller announces a new game. If the game is a new "special" game with a corresponding new color, the player repositions the game board 10 relative to the marker sheet 20 by lifting the game board off of the pegs 28 and visually aligning the windows 16 with the markings 24 of the announced color. The player then lowers the board 10 until the pegs 28 securely engage the appropriate positioning openings 18. The game board 10 is now ready for another "special" Bingo game to be played.

After the number of "special" games played exceeds the number of markings 24 in a group 25, the player removes marker sheet 20 along with board 10 from the pegs 28. The sheet is then flipped over and repositioned on pegs 28, thereby exposing unmarked groups 25 of markings 24 on the second opposite surface as discussed above. The player then repeats the steps described above to play more "special" games.

In the specific embodiment shown in the drawings, there are nine individually colored markings 24 in each group 25, each group consisting of three parallel rows of three markings. Likewise, positioning openings 18 are arranged in three parallel rows of three for each corresponding peg 28. Thus, the game board 10 may be positioned in two perpendicular directions (i.e., horizontally and vertically in FIG. 2) with respect to the marker sheet 20. In this embodiment, nine "special" games may be played on one side of a marker sheet and nine additional "special" games may be played on the other side.

Of course, the number and arrangement of the groups 25 and openings 18 is arbitrary. In maximizing the number of "special" games which may be played, the skilled artisan should consider the maximum desired size of the defined areas 12 and the minimum size of the window 16 required to allow cancelling of the marking 24 with a pencil 30. Since the present invention allows movement of the game board relative to the marker sheet in two perpendicular directions, the number of "special" games is maximized because a maximum number of colored markings are subsequently exposed.

To further prevent tampering of the Bingo game, the insert sheet 20 may have a reference code, e.g., 12345 in FIGS. 1 and 2, which corresponds to the particular special" being played. This reference code is visible to the player via a cut-out 19 located through the game board 10. In addition, game board 10 may also be marked with another reference code, e.g., 4765 in FIGS. 1 and 2, to aid in preventing tampering. This reference code may be located in the center area 12 marked "FREE SPACE."

Various improvements and modifications will become apparent to the skilled artisan. For example, the pegs 28 may extend from a desk or table top rather than from a support board, such that the pegs are fixed relative to the marker sheet. Such a construction is especially advantageous in locations where Bingo is played on a regular basis. In addition, any other suitable fastener may be substituted for the pegs which allows the game board to be positioned relative to the marker sheet.

Many other modifications and variations of the present invention are made possible in light of the above teachings. It is therefore to be understood that the invention may be practiced otherwise than as specifically described and that the scope of the invention is limited only by the following claims.

I claim:

1. A game board for the play of a game such as Bingo, comprising:

a panel having a plurality of areas of a predetermined size defined on an upper surface of said panel;

a plurality of windows, each window being located within a defined area of said panel;

a plurality of characters for facilitating play of the game, each character being located within a defined area of said panel; and means for permitting movement and securing said panel relative to a marker sheet in two perpendicular directions, wherein said means for permitting movement and securing in the two perpendicular directions comprises a plurality of openings in said panel which are arranged in the two perpendicular directions in a predetermined fashion and at least one peg passing through the marker sheet and through said panel openings, whereby said characters may be cancelled during play of the game by marking the marker sheet through said windows.

2. The game board according to claim 1, further comprising a support board located beneath the marker sheet, said support board connected to said pegs.

3. The game board according to claim 2, wherein there are nine of said openings arranged in three rows of three markings each.

4. A combination game board and insert sheet for the play of a game such as Bingo, comprising:

a marker sheet having a plurality of groups of colored markings arranged in a predetermined fashion in two perpendicular directions on a first surface;

a panel having a plurality of areas of a predetermined size defined on an upper surface of said panel;

a plurality of windows, each window being located within a defined area of said panel;

a plurality of characters for facilitating play of the game, each character being located within a defined area of said panel; and means for permitting movement and securing said panel relative to said marker sheet in the two perpendicular directions, wherein said means for permitting movement and securing said panel in the two perpendicular directions comprises a plurality of openings in said panel which are arranged in the two perpendicular directions in the same predetermined fashion as the markings and at least one peg passing through said marker sheet and through at least one of said panel openings, whereby said characters may be cancelled during play of the game by marking said marker sheet markings through said windows.

5. The combination according to claim 4, further comprising a support board located beneath said marker sheet, said support board connected to said peg.

6. The combination according to claim 5, wherein there are nine of said openings arranged in three rows of three openings each and each group comprises nine markings arranged in three rows of three markings each.

7. The combination according to claim 4, wherein said marker sheet further has a plurality of groups of colored markings on another surface arranged in the same predetermined fashion as the groups of markings on the first surface.

8. A marker sheet for multiple use in the play of a game, such as Bingo, with a game board having a plurality of game characters arranged on an outer surface and windows associated with the characters, each character and associated windows located within a defined area, the marker sheet being substantially rectangular and having groups of mutually distinct markings arranged on a first surface in two perpendicular directions, each group corresponding to a defined area of the game board and a marking of each group being visible through the windows of the game board when the game board is positioned above the first surface, further comprising holes located through the marker sheet in the two perpendicular directions for engaging at least one peg which in turn engages the game board.

9. The marker sheet according to claim 8, further comprising groups of mutually distinct markings arranged on a second surface opposite the first surface in two perpendicular directions, each group corresponding to a defined area of the game board and a marking of each being visible through the windows of the game board when the game board is positioned above the second surface.

10. The marker sheet according to claim 9, wherein the markings in each group are individually colored.

11. The marker sheet according to claim 9, wherein each group comprises three rows of three markings each.

12. The marker sheet according to claim 8, wherein the markings in each group are individually colored.

13. The marker sheet accordeing to claim 8, wherein each group comprises three rows of three markings each.

* * * * *